United States Patent [19]

Taylor

[11] 4,297,556

[45] Oct. 27, 1981

[54] PUSHBUTTON OPERATOR

[76] Inventor: Glenn R. Taylor, 108 Duncan Cir., Beaver, Pa. 15009

[21] Appl. No.: 180,629

[22] Filed: Aug. 25, 1980

Related U.S. Application Data

[63] Continuation of Ser. No. 13,664, Feb. 21, 1979, abandoned.

[51] Int. Cl.[3] ..... H01H 3/12

[52] U.S. Cl. ..... 200/330; 200/340

[58] Field of Search ..... 200/153 T, 296, 307, 200/330, 340, 159 B, 159 R, 159 A, 302; 400/490, 492, 493, 495

[56] References Cited

U.S. PATENT DOCUMENTS

| | | | |
|---|---|---|---|
| 3,018,338 | 1/1962 | Mullen et al. | 200/296 |
| 3,121,777 | 2/1964 | Gallas | 200/330 |
| 3,239,641 | 3/1966 | Pettit | 200/330 |
| 3,304,398 | 2/1967 | Stallman | 200/340 |
| 3,305,660 | 2/1967 | Sohns et al. | 200/330 |
| 3,594,529 | 7/1971 | Cartwright | 200/330 |
| 3,866,008 | 2/1975 | Teruzzi | 200/330 |
| 3,964,593 | 6/1976 | Pointon | 200/159 B |
| 3,975,604 | 8/1976 | Appleton | 200/303 |

FOREIGN PATENT DOCUMENTS

| | | | |
|---|---|---|---|
| 2128295 | 12/1971 | Fed. Rep. of Germany | 200/296 |
| 1048795 | 11/1966 | United Kingdom | 200/330 |

*Primary Examiner*—John W. Shepperd

*Attorney, Agent, or Firm*—Webb, Burden, Robinson & Webb

[57] ABSTRACT

A pushbutton linear operator for use with an electrical contact block includes a base portion, which is preferably rectangular, and a hollow cylindrical extension having external threads on an end opposite the base portion. A pushbutton having a flush, extended or mushroom cap connected to a stem is disposed in the extension. A base plate, also preferably rectangular, is integrally formed with the stem and fits within the base portion of the operator. A clamp ring is threaded to the extension to retain the cap, stem and plate in the extension and base portion of the operator. The operator is adapted to be connected to a biased contact block or biasing means may be included in the extension to "load" the pushbutton operator against a gasket for "Oil-Tite" sealing.

2 Claims, 12 Drawing Figures

FIG. 1
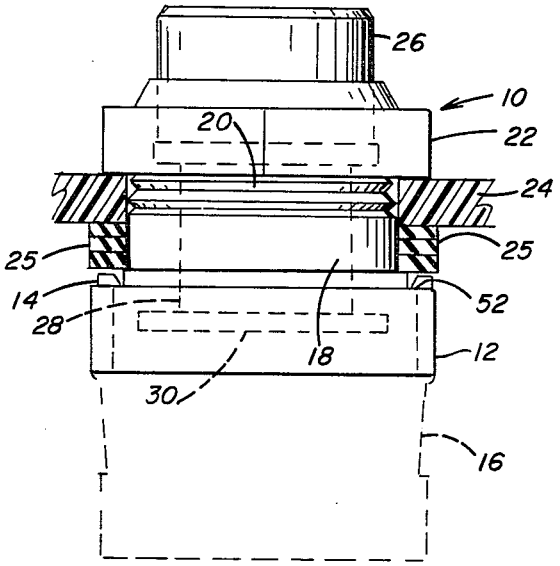
FIG. 2
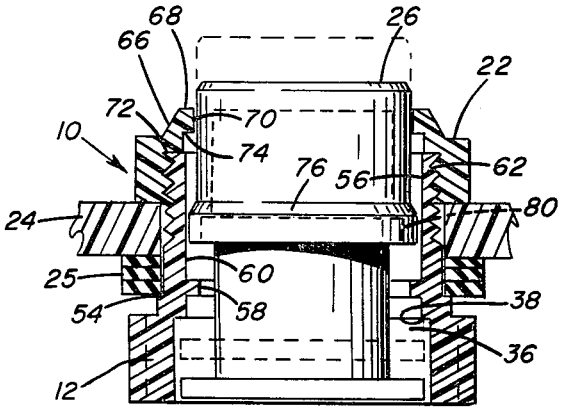
FIG. 3
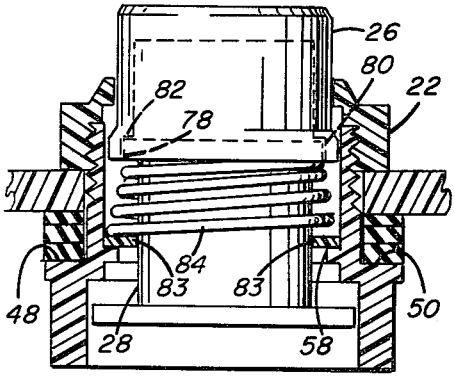
FIG. 4
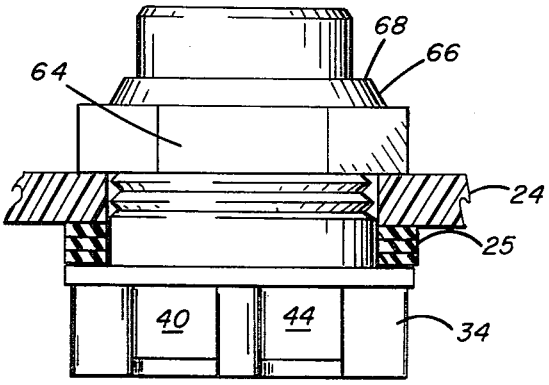
FIG. 6
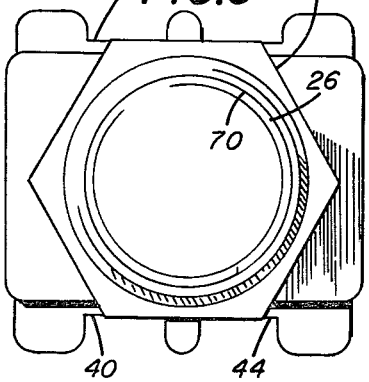
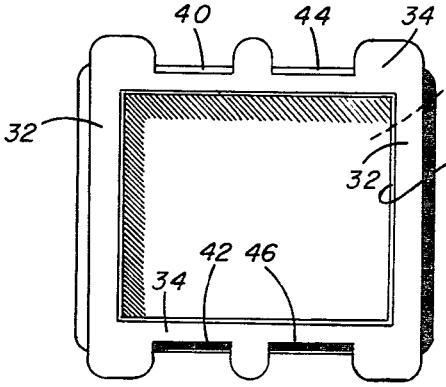
FIG. 5

PUSHBUTTON OPERATOR

This application is a continuation of application Ser. No. 13,664, filed Feb. 21, 1979 now abandoned.

FIELD OF THE INVENTION

This invention relates to linear operators, and particularly to operators known as pushbutton operators which are useful for actuating electrical contact blocks in order to make and break electrical circuits. A preferred form of contact block with which the present invention is suitable is that described in my co-pending application Ser. No. 13,665, filed Feb. 21, 1979 and entitled "CONTACT BLOCK", the disclosure of which is specifically incorporated by reference.

More particularly, the invention relates to several embodiments of linear operators which may be characterized by flush, extended and mushroom caps. The operators may be normally "unloaded", that is, they may not include a biasing means and are loaded by the contact block to which they are connected in use. The operators may be "loaded", that is, they may carry biasing means, such as a coil spring, which normally maintains the pushbutton in an extended or non-operative position and retains a gasket for "Oil-Tite" sealing.

BACKGROUND OF THE INVENTION

A number of linear operators, e.g. pushbutton operators, for use with contact blocks to provide electrical switches are shown in the patented art. For example, U.S. Pat. Nos. 3,136,868; 4,064,381 and others disclose forms of pushbutton operators. The present invention has the specific advantages over prior art pushbutton operators of simplicity, ease of assembly and minimization of parts. Other advantages of the present invention will appear from the following specification and the accompanying drawings.

SUMMARY OF THE INVENTION

A linear pushbutton operator for use with an electrical contact block comprises a base portion, which is substantially rectangular, and a hollow cylindrical extension having external threads on an end opposite the base portion. In one embodiment, a pushbutton in the form of a hollow cylindrical cap having an internal shoulder is disposed within the cylindrical extension and is press fit with a hollow cylindrical stem integrally formed with a base plate, which is also preferably rectangular, which fits within the rectangular base portion of the operator. The stem and base plate are preferably formed in one piece and made of an insulating plastic material. The upper end of the stem has a diameter slightly less than the maximum internal diameter of the cap such that there is a frictional engagement between the inner wall of the cap and the outer diameter of the stem when the cap is pressed onto the stem to the extent that the shoulder of the cap rests upon the upper end of the stem.

The cap may be retained in the operator between an annular ring formed in the lower end of the extension and having an internal diameter larger than the maximum diameter of the stem which passes through it. The annular ring has a top surface which forms a stop for the bottom of the cap.

A clamp ring having internal threads adapted to engage the threads of the extension provides means for preventing the cap to separate from the stem and also serves to secure the operator in a panel.

In another form of the invention, a biasing means, for example a coil spring, is disposed around the stem between the annular ring and an annulus on the top of the stem. The stem and cap are thus maintained in the extended position. Further, a wiping gasket may be disposed around the stem between the annular flange and the annular ring and held tight against the ring by the spring to provide sealing commonly referred to as "Oil-Tite".

In other forms of the invention, flush, extended and mushroom caps are connected to the stem to provide the pushbutton operator.

The components of the pushbutton operator are molded from thermoplastic materials.

A complete understanding of the invention will be had from a consideration of the following specification taken with the accompanying drawings.

BRIEF DESCRIPTION OF THE DRAWINGS

In the Figures:

FIG. 1 is an elevation view of a pushbutton operator having an extended cap in an extended position in accordance with the present invention with a connected contact block shown in dotted lines;

FIG. 2 is a cross-sectional view taken on the plane through the vertical axis of a form of the operator shown in FIG. 1 with the pushbutton cap in a depressed position;

FIG. 3 is a cross-sectional view taken on the plane through the vertical axis of a second form of the operator shown in FIG. 1 with the pushbutton cap in an extended position;

FIG. 4 is an elevation view of the operator taken at 90° to the view shown in FIG. 1;

FIG. 5 is a bottom view of the operator shown in FIGS. 1–4;

FIG. 6 is a top view of the operator shown in FIGS. 1–4;

BRIEF DESCRIPTION OF PREFERRED EMBODIMENTS OF THE INVENTION

Figure 7:
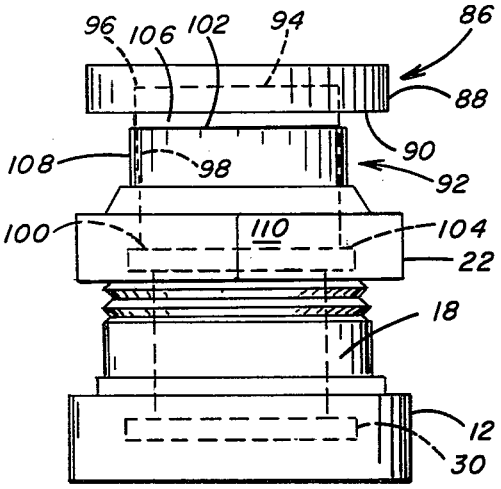
FIG. 7 is an elevation view partially in phantom of a pushbutton operator having a mushroom cap in accordance with the present invention.

In the various forms of the invention disclosed herein, many of the components of the pushbutton operator are interchangeable. Accordingly, for convenience, the same numerals are used in the drawings to refer to the same components irrespective of the form of the invention being described.

In general, as shown in FIG. 1, the pushbutton operator 10 according to the present invention comprises a base portion 12 which is adapted to be connected by extending arms 14 to a contact block 16 (shown in dotted lines) having a stroker and containing stationary and movable contacts forming an electrical switch. A hollow cylindrical extension 18 has external threads 20 on its upper end. A clamp ring 22 having internal threads is adapted to be tightened on the extension 18 against a panel 24 (a portion of which is shown) having gaskets 25 to mount the operator.

Within the operator is a pushbutton cap 26 which is adapted to be depressed to actuate the stroker and the contact block 16. The cap is mounted on an elongated hollow cylindrical member or stem 28 by a press fit or "snap-on" action. A rectangular flat base plate 30 having dimensions slightly less than the inside of the rectangular base portion 12 is integrally formed with the stem 28. The rectangular configuration of the base portion and the base plate permits abutment of the two during assembly and any printing on the assembly facilitating assembly and printing.

In use, the pushbutton cap 26 is normally fully extended as shown in FIG. 1, being retained in that position by a biased projection on the stroker of the contact block being pressed firmly against the bottom surface of base plate 30. When the pushbutton is depressed as shown in FIG. 2, the bias of the stroker is overcome by the force exerted to change the contact block from a normally open to a normally closed electrical condition, or vice-versa, as the case may be.

More specifically, with reference to FIGS. 2–6, the base portion 12 of the pushbutton operator 10 is substantially rectangular in cross section and has four upstanding walls 32, 34 defining a central opening 36 in which the plate 30 is reciprocally disposed. The opening 36 has a top wall 38 against which the upper surface of plate 30 abuts when the pushbutton is in its extended position. On the outer surface of two opposed walls 34 are two recesses or notches 40, 42 for connection to at least one contact block 16. A second contact block may be connected to the operator using a notch 44 in wall 34 and a notch 46 directly opposite notch 44 in the opposed upstanding wall 34. Ledges 48, 50 are provided in the outside wall 34 to secure the inwardly extending flanges 52 on the arms 14 of the contact block (see FIG. 1).

The hollow cylindrical extension 18 is integrally formed on the upper surface 54 of top wall 38. The bore 56 of the extension communicates with the opening 36. An annular ring 58 extends radially into the bore 56 from the sidewall 60 to provide a stop at the lower end of the extension 18. The bore 56 has a constant internal diameter throughout its length from the ring 58 to the opposite end of the extension.

Threads 20 extend on the outside surface of the extension 18 from the opposite end partially along the extension toward the base portion 12. A clamp ring 22 having internal threads 62 is adapted to be threaded to the extension 18. The outer surfaces 64 of the clamp ring 22 preferably define a hexagon which permits the clamp ring to be tightened by hand or with conventional tools. The top surface 66 of the clamp ring is tapered for appearance to a top surface 68 having a circular opening 70 just slightly larger in diameter than the outside diameter of cap 26 which is adapted to extend therethrough. The inside of the clamp ring is characterized by a pair of annular lips 72, 74. The lip 72 serves a limit for threading the clamp ring 22 to the extension 18 by means of abutment with the top wall of the extension when tightening. The lip 74 which extends from sidewall 60 limits the outward travel of the pushbutton by engaging an external annular flange 76 on the outer surface of cap 26.

There is an annulus 78 on the upper end of the stem 28 which is of slightly less diameter than the maximum diameter of bore 80 in the cap 26 to provide frictional engagement between the outside surface of the annulus 78 and the bore 80. A narrow radial shoulder 82 is also defined within the cap by a reduction in the bore diameter. The shoulder 82 limits the extent to which the cap 26 can be pressed onto the stem 18 by abutting the top of the stem.

Assembly of cap 26, stem 28 and base plate 30 in the operator is not difficult. First, the plate 30 and stem 28 are inserted into the base portion 12 and extension 18. Next, the cap 26 is conveniently "snapped-on" to the annulus 78 at the upper end of the stem. Finally, the clamp ring 22 is threaded to the extension 18 and tightened until the operator is firmly mounted in a panel or the like. When a contact block 16 or contact blocks are connected to the operator, the pushbutton cap 26 is extended as shown in FIG. 1 under the "loading" of the contact block and it is ready for use.

In another form of the invention shown in FIG. 3, a gasket 83 is added to provide sealing or oil tightness. In addition, a coil spring 84 is added to hold the gasket in place and to bias the pushbutton open against added forces of the gasket. The coil spring 84 is placed between the gasket and the annular ring 58 at the bottom of the extension 18 and the annulus 78 on the upper end of the stem 28. In this form the pushbutton 10 is always in its extended position under the bias of spring 84 which may be overcome simply by depressing the cap 26.

Figure 8:
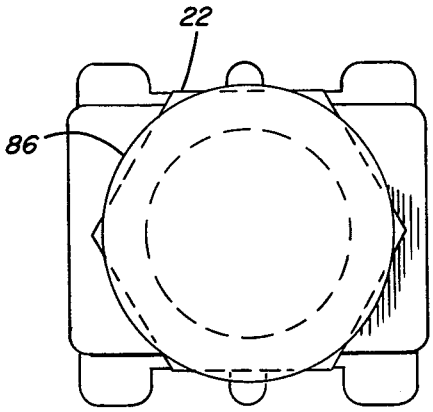
FIG. 8 is a top view of the operator shown in FIG. 7.

In another form of the invention which embodies a mushroom cap illustrated in FIGS. 7 and 8, the same basic components are used with the exception of the cap 26. In this form, mushroom cap 86 consists of a circular member 88 having a substantially flat bottom surface 90 and a short cylindrical section 92. A cylindrical cavity 94 having a depth less than the thickness of the member is centrally located in the surface 90. A narrow shoulder 96 extends around the circumference of the cavity, the outer diameter of which is just slightly less than the inner diameter of the opening in clamp ring 22.

The section 92 comprises a hollow length including an internal bore 98 having the maximum diameter just slightly larger than the outer diameter of the annulus 78 on the stem and a shoulder 100 which limits the extent to which the section 92 can be "snapped-on" to the stem 28. The outside of the section 92 is characterized by a pair of circumferential shoulders 102 and 104. The shoulder 102 is defined by the difference in diameter between the top portion 106 of the section 92 and the diameter of the middle portion 108 which is slightly larger. The diameter of top portion 106 is such that the top portion will fit within the cavity 94 in the circular member 88 where it is solvent bonded, glued or ultrasonically welded. The shoulder 104 is more smoothly tapered than shoulder 102 and is defined by the difference in diameter between middle portion 108 and lower portion 110. The diameter of the middle portion 108 is slightly less than the diameter of the opening in the clamp ring 22 such that the section 92 extends therethrough to an extent limited only by the engagement of shoulder 104 with lip 74 inside the clamp ring.

To assemble the mushroom cap operator, the stem 28 and plate 30 are first inserted into the base portion 12 and extension 18 of the operator as before. A sub-assembly is then made by inserting the section 92 into the clamp ring 22 to its full extent and the member 88 is frictionally engaged to section 92 by placing the top portion 106 into the cavity 94 and welding, bonding or gluing. Thereafter, the lower portion 110 of the section 92 having an internal diameter slightly greater than the outer diameter of the annulus 78 is snapped onto the annulus 78 of the stem and the clamp ring 22 is threaded onto the extension 18 as in the case of the previously described form of the operator.

It will be evident to those skilled in the art that a gasket and a coil spring may be placed in the assembly as shown in FIG. 3 and the mushroom cap substituted for the extended cap to provide an oil tight seal. The spring is placed around the stem 28 between the annular ring 58 in the base of the extension 18 and the annulus 78 on the upper end of the stem to provide a "loaded" mushroom cap pushbutton operator. This modification is even more apparent when viewed with the drawing and description of FIG. 3 herein.

Figure 9:
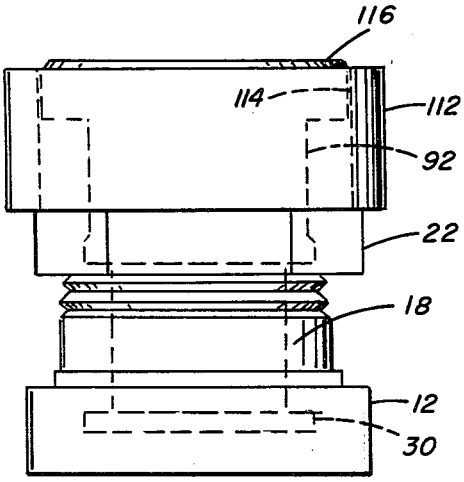
FIG. 9 is an elevation view partially in phantom of a pushbutton operator having a modified clamp ring with a mushroom cap in accordance with the present invention.
Figure 10:
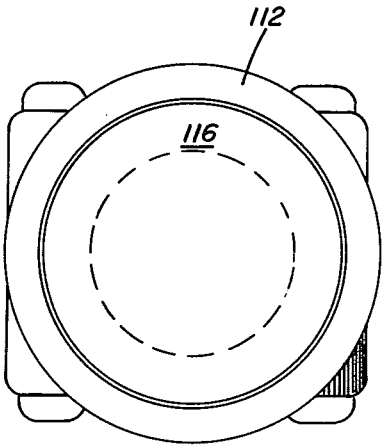
FIG. 10 is a top view of the operator shown in FIG. 9.

In a further form of the invention shown in FIGS. 9 and 10, an operator with a mushroom cap is provided; however, the clamp ring 22 is modified to present the top of the cap flush with the modified clamp ring. In all other respects this form of the pushbutton operator is identical to that described hereinabove. The modification to the clamp ring comprises an annular upstanding wall 112 which extends upwardly from and is integrally molded with the upper surface of the clamp ring 22. The inside diameter of the opening 114 defined by the wall is slightly larger than the outside diameter of circular member 88 which forms a part of a mushroom cap, the other part being a section 92. The depth of the wall is such that when the member 88 is secured to section 92 by solvent bonding, gluing or ultrasonic welding with the modified clamp ring therearound, in its uppermost position (e.g. under loading by a contact block) wherein the shoulder 104 engages the lip 72, the top surface 116 of member 88 is substantially flush with the upper edge of the wall 114. This modified form is useful to provide a large pushbutton which can be easily actuated, but one which is sufficiently recessed that it cannot be operated accidentally. In addition, the larger pushbutton is useful when the operator is used with multiple contact blocks since more than one finger can be used on the button surface 116 to overcome the force of the biasing means in the plural contact blocks. This modified form of the operator may also be loaded with a spring in the same manner as previously described with respect to loading the form of the operator shown in FIGS. 7 and 8.

Figure 11:
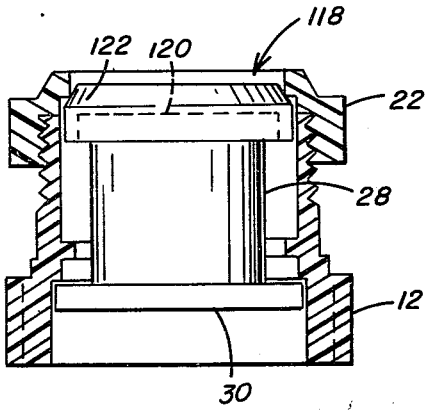
FIG. 11 is a cross-sectional view of a pushbutton operator having a flush cap.
Figure 12:
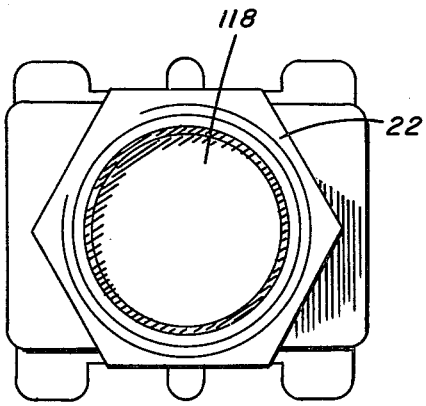
FIG. 12 is a top view of the operator shown in FIG. 11.

Another exemplary form of the invention shown in FIGS. 11 and 12 of the drawings employs the same components as are used in connection with the forms of the invention shown in FIGS. 1–6, with the exception of the pushbutton cap. Pushbutton cap 118 is substantially shorter in length than cap 26 although the inside of the cap also includes a shoulder 120 at substantially the same depth from the bottom edge as shoulder 82 in cap 26 for location of the top of stem 28. There is no flange on the outer wall of cap 118. In assembling this form of the invention, the shorter cap 118 is press fitted on the top of the stem before clamp ring 22 is threaded onto the top of the stem. The edges of cap 118 are slightly tapered at 122 such that they fit snugly against the lip 72 in the clamp ring when the operator is loaded by a contact block or, in a modified version, by a spring in the case of the sealed operator in the manner shown in FIG. 3. This form of the pushbutton operator provides a button which can be actuated if desired, but which otherwise is sufficiently substantially flush to eliminate accidental operation.

In summary, the present invention in the forms described, provides exceptional desirability and economy. The components of the pushbutton operators are interchangeable, and flush, extended and mushroom caps may be used. Appropriate legends may be stamped on the pushbuttons, such as "stop", "start", "emergency", etc. and the components may be made from color-coded materials. Conventional tools may be used for rapid and easy installation and replacement.

Having described presently preferred forms of the invention, it is to be understood that they may be otherwise embodied within the scope of the appended claims.

I claim:

1. A pushbutton operator for use with an electrical contact block having a stroker for actuating the block comprising:

A. a base portion and a hollow cylindrical extension made of insulating thermoplastic material having external threads on an end opposite the base portion;

B. a cap connected to a stem and disposed in the extension, the cap including an annular shoulder on its outside wall;

C. a base plate connected to the stem and located within the base portion;

D. means on the base portion for connection to the contact block; and

E. a clamp ring threaded to the extension to retain the cap, stem and plate in the extension and base portion of the operator, the clamp ring including an internally threaded bore having a pair of annular lips, the first lip comprising a limit for threading the clamp ring to the extension by the abutment of the first lip with the top of the extension and the second lip being of a smaller diameter than the first lip but larger than the annular shoulder on the cap to retain the cap within the extension whereby when the operator is connected to a contact block the stroker abuts the plate to load the operator and depression of the cap moves the plate against the stroker to actuate the contact block.

2. A pushbutton operator for use with an electrical contact block having a stroker for actuating the block comprising:

A. a base portion having a top wall with an opening therein;

B. a cylindrical extension having external threads on an end opposite the base portion and including a bore in communication with said opening;

C. a unitary stem and base plate;

D. the stem disposed in the bore and opening and the base plate formed on an end of the stem and disposed within the base portion;

E. a cap secured to the top of the stem at the end opposite the base plate;

F. means on the base portion for connection to the contact block; and

G. a clamp ring having an internal annular lip extending around the top surface thereof threaded to the extension, said cap, stem and plate being retained in the extension and base portion of the operator by abutment of a surface of the cap with the internal annular lip of the clamp ring such that when the operator is connected to a contact block the stroker abuts the plate to load the operator and depression of the cap moves the plate against the stroker to actuate the contact block.

* * * * *